United States Patent [19]

Duggan

[11] Patent Number: 4,658,761

[45] Date of Patent: Apr. 21, 1987

[54] TREATMENT OF BOILER TUBES

[76] Inventor: Alain J. Duggan, 97 Kallenbach Drive, Linksfield Ridge, Johannesburg, South Africa, 2198

[21] Appl. No.: 671,958

[22] Filed: Nov. 15, 1984

[30] Foreign Application Priority Data

Nov. 19, 1983 [ZA] South Africa ..... 83-8003

[51] Int. Cl.[4] ..... F22B 15/00; F22B 25/00; F22B 37/10

[52] U.S. Cl. ..... 122/235 C; 122/511; 122/DIG. 13; 427/226; 427/379; 427/380

[58] Field of Search ..... 122/DIG. 13, DIG. 14, 122/511, 235 C; 165/177; 427/226, 379, 380

[56] References Cited

U.S. PATENT DOCUMENTS 2,781,636 2/1957 Brandes et al. ..... 122/DIG. 14
3,734,767 5/1973 Church et al. .
3,789,096 1/1974 Church et al. .
3,817,781 6/1974 Church et al. .
3,873,344 3/1975 Church et al. .
3,925,575 12/1975 Church et al. .
3,944,683 3/1976 Church et al. .
3,956,531 5/1976 Church et al. .
3,985,916 10/1976 Church et al. .
4,007,020 2/1977 Church et al. .

FOREIGN PATENT DOCUMENTS 0023801 2/1979 Japan ..... 122/DIG. 13

*Primary Examiner*—Edward G. Favors
*Attorney, Agent, or Firm*—Bacon & Thomas

[57] ABSTRACT

The invention relates to the protection of metal boiler tubes from corrosion and erosion. Accordingly, the invention provides a metal boiler tube whereof at least a selected part of its surface is initially porous and whereof the initially porous surface has been coated with at least one stable metal oxide by the aplication to the porous surface of a solution containing salts or oxides of such metals followed by the conversion of such salts or treatment of such oxides of metals to attach the stable metal oxides to the porous surface.

14 Claims, 2 Drawing Figures

TREATMENT OF BOILER TUBES

FIELD OF THE INVENTION

THIS INVENION relates to the treatment of boiler tubes to render them more resistant to corrosion or erosion, or both.

BACKGROUND TO THE INVENTION

A serious problem is frequently encountered in coal and oil fired boilers and this is often more serious in boilers of large size such as those which are used in electricity generating stations. This problem is two-fold:

(a) Erosion of boiler tubes by fly ash carried by the combustion gases used to heat the boiler tubes takes place and increased temperature accentuates such erosion.

(b) Corrosion of the boiler tubes takes place resulting from the presence of corrosive elements in the fuel, in particular sulphur, chlorine and vanadium. On combustion of the fuel, these elements form corrosive products which corrode the metal surface of the boiler tubes.

In some areas, notably superheater zones, corrosive slags may deposit on the tubes. This also results in corrosion of the tubes.

Such erosion and corrosion can result in very high replacement costs not only in the costs of the tubes themselves but also in the costs associated with downtime of the boiler.

It will of course also be appreciated that the poorer the quality of the coal available for firing the boiler, the higher the erosive and corrosive character of the ash, and the greater is the problem.

Many attempts have been made to find an economical solution to this problem but, to the applicant's knowledge, no satisfactory solution has been achieved. In the United Kingdom the problem is mainly a corrosive one. Extensive research work has been conducted there by the Central Electricity Generating Board but the problem remains unresolved. The closest to any form of success that has been achieved, as far as the applicant is aware, is the use of an expensive technique whereby corrosion resistant metal alloys are co-extruded over mild steel tubes in which case costs are five to fifteen times higher than for mild steel tubes.

Thermally sprayed metal and ceramic coatings have not proved successful due to their inherent porosity. This permits the ingress of corrosive gases resulting in the formation of corrosion products at the interface between the tube and coating. This often results in the coating being lifted off by substrate oxidation, and this problem is aggravated by the build-up of slag.

The applicant has now achieved remarkably surprising results by employing a process whereby such sub-coating corrosion is at least inhibited.

SUMMARY OF THE INVENTION

According to this invention there is provided a metal boiler tube whereof at least a selected part of its surface is initially porous and such porous surface has been coated with at least one stable metal oxide by the application to the porous surface of a solution or suspension containing salts or oxides of such metals followed by conversion of such salts or treatment of such oxides of metals to attach the stable metal oxides to the porous surface.

Further features of the invention provide for the boiler tube to have been coated by a series of applications of such solution or suspension and conversions or treatments; and for the boiler tube to have been coated by a plurality of different stable metal oxides, each stable metal oxide being provided by at least one application and conversion or treatment.

A still further feature of the invention provides for the boiler tube to be made either of mild steel or any required alloy steel.

The invention also provides for the tube surface to be inherently porous or for the porous surface to be provided by coating the tube with a porous metal or oxide coating.

A suitably porous metal or oxide coating may be applied by metal spraying in which case, subdivided metal or oxide is applied to the surface by spraying, by painting, or by dipping. In addition, the methods of chemical or electro-plating may be used for applying a porous metal coating, while slurry coating and mudding methods may be used for applying an oxide coating.

The slurry used in a slurry coating method is a liquid based mixture of one or more finely divided refractory oxides which may optionally contain any of the following:

a small amount of impregnating solution, a small amount of organic wetting agent, or ceramic reinforcement fibres. The slurry, moreover, may contain a high percentage of metal powder including chromium or nickel chromium alloy, and other finely powdered materials of high abrasion or corrosion resisting capacity, for example, silicon carbide, boron carbide, and titania-lead glass.

Slurries such as described above may be applied directly to the metal surface.

In the situation where the tube surface is inherently porous, it is preferable to roughen the tube surface by treating it with oxidizing acids prior to coating it with a stable metal oxide. For the case where the tube is first metallized prior to such coating, it is preferable to roughen the tube surface by grit-blasting.

Preferred metal coatings to be applied according to the invention may be selected from the following: nickel-chrome alloy, nickel-aluminide alloy, high chrome iron alloy.

It will be understood that the metal coating may serve the role of a stress-relieving layer upon which a further layer, comprising oxide or metal, may be applied.

It will also be understood that the above-described preparations are destined to provide a porous layer of varying depth which is adapted to receive the solution or suspension. Thus, when spraying techniques are to be used, combustion guns, plasma guns, detonation guns and additionally, for metal spraying, electric arc and jet coat apparatus are suitable.

Suitable compounds capable of conversion to stable metal oxides and which are soluble include, for example, cerrous nitrate, zirconyl chloride, cobalt and nickel nitrates, titanium oxalate, silico-tungstic acid, magnesium chromate, beryllium nitrate, chromium trioxide, chromium sulphate, chromium chloride, and the like. The application to the porous tube surface of a concentrated solution of chromic acid is particularly preferred.

According to a second aspect of the invention, there is provided a method of protecting a boiler tube from erosion and corrosion whereby a selected part of the surface of the tube is prepared as required, to make it porous, a solution or suspension containing salts or oxides of metals which are capable of being converted or treated to produce stable metal oxides is applied to the porous surface; and such conversion or treatment is effected.

BRIEF DESCRIPTION OF ILLUSTRATIONS

FIG. 1 illustrates the corrosion and erosion on the curved portion of a "U"-shaped section of a standard boiler tube 18 months after installation in an operating coal-fired boiler, and FIG. 2 is a similar view of a boiler tube according to the invention 18 months after installation in the same section of the coal-fired boiler referred to above.

DETAILED DESCRIPTION WITH REFERENCE TO AN EXAMPLE

Figure 2:
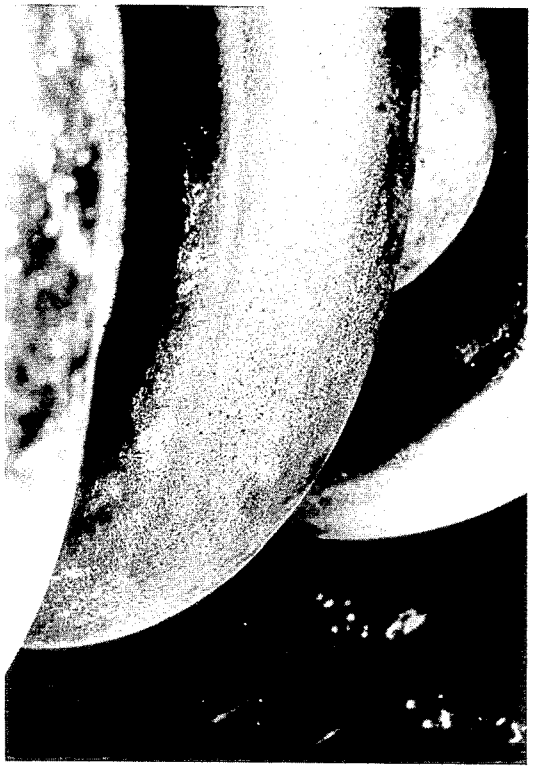
Figure 1:
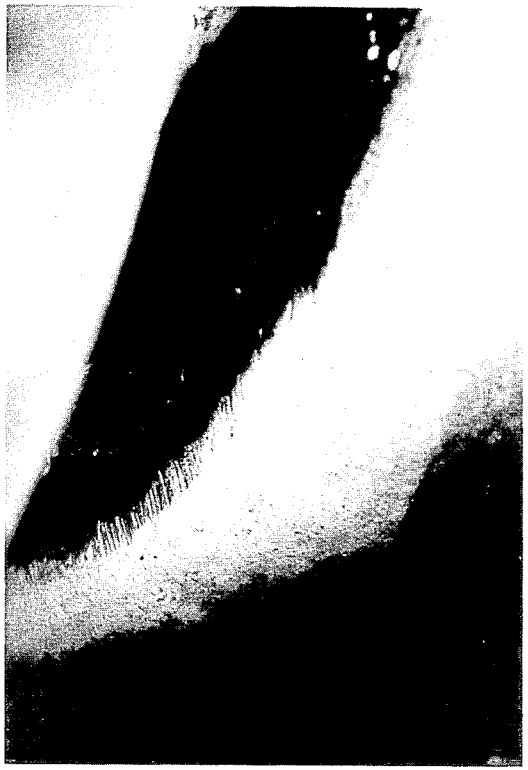

In a specific example of this invention which is not to be interpreted in any way as limiting the scope of this invention, a "U"-shaped section of standard mild steel boiler tube, substantially as illustrated in FIGS. 1 and 2, is coated to produce a tube according to this invention. The dimensions of the tube are approximately 0.1 meter in diameter and the length of the legs of the "U"-shape are about 0.75 meter, with the radius of the bend being about 0.2 meter.

The outer surface of the "U"-shaped tube is prepared by grit-blasting to put it in a condition which will readily accept a metal spray coating.

The metal which is applied has an 80% nickel and 20% chrome content and forms a porous coating having a thickness of about 0,5 mm.

The coated 'U"-shaped tube is then immersed in a concentrated solution of chromic acid at room temperature and atmospheric pressure. After being allowed to drip-dry, the "U"-shaped tube is heated at 525° C. for a period of twenty minutes in a circulatory draught electric furnace. Immersion of the "U"-shaped tube into chromic acid, followed by drip-drying and heating is repeated eighteen times to increase the mass of chromic oxide deposits in the pores of the nickel chromium coating.

"U"-shaped tubes treated as above-described were installed in a boiler for test purposes and compared to standard "U"-shaped tubes installed in the same boiler and subjected to identical operating conditions. It was found that the coated tubes, an example of which is illustrated in FIG. 2, remained in a fully satisfactory condition while the standard tubes, an example of which is illustrated in FIG. 1, were seriously eroded after a continuous period of use of about eighteen months.

As previously stated, the above example is not to be considered as limiting the invention. Many variations to the example may be made, inlcuding the application of different coatings and different metal salt or metal oxide containing solutions. The heating cycle may also vary, depending on the nature of the solutions being applied to the porous surface. Further, the thickness and density of the coating may be varied to meet the particular requirements of the application for which the coated tube will be used.

It will be understood that the chromic oxide described above may be treated still further, and for example, may be dipped in a solution of phosphoric acid and heated to a temperature of at least 300° C.

It is noted that one of the most attractive features of the process is its low cost in relation to other methods of boiler tube protection.

What I claim as new and desire to secure by letters patent is:

1. A metal boiler tube having an outer layer of metal and metal oxide formed by metal spraying which is resistant to corrosion under the conditions to which the boiler tube is subjected in use; said layer being impregnated by at least chromium oxide by the application to the layer of a solution containing salts of chromium followed by conversion of such salts to chromium oxide.

2. A metal boiler tube according to claim 1 which has been coated by a series of applications and conversions or treatments.

3. A metal boiler tube according to claim 1 which is made of mild steel.

4. A metal boiler tube according to claim 1 which is made of alloy steel.

5. A boiler tube according to claim 1 in which the selected surface is roughened by treating it with acids or by grit-blasting.

6. A boiler tube according to claim 1 in which the outer layer of metal and metal oxide is selected from the group consisting of: nickel-chrome alloy, nickel-aluminide alloy and high chrome iron alloy.

7. A boiler tube according to claim 1 in which the outer layer of metal and metal oxide is provided by coating the tube with oxide.

8. A boiler tube according to claim 1 to which a phosphoric acid solution has been applied, and which has been heated to at least 300° C. after such phosphoric acid application.

9. A method of protecting a metal boiler tube from erosion and corrosion comprising applying an outer layer of metal and metal oxide, which is resistant to erosion and corrosion under the conditions to which the boiler tube is subjected in use, by metal spraying and impregnating said outer layer with at least chromium oxide by the application to the outer layer of a solution containing salts of chromium oxide followed by conversion of such salts to chromium oxide.

10. A boiler tube according to claim 1 in which the outer layer is applied by means of combustion guns.

11. A boiler tube according to claim 1 in which the outer layer is applied by means of plasma guns.

12. A boiler tube according to claim 1 in which the outer layer is applied by means of detonation guns.

13. A boiler tube according to claim 1 in which the outer layer is applied by means of an electric arc.

14. A boiler tube according to claim 1 in which the outer layer is applied by means of a jet coat apparatus.

* * * * *